US008952674B2

(12) United States Patent
Mitchell et al.

(10) Patent No.: US 8,952,674 B2
(45) Date of Patent: Feb. 10, 2015

(54) VOLTAGE REGULATOR CIRCUITRY OPERABLE IN A HIGH TEMPERATURE ENVIRONMENT OF A TURBINE ENGINE

(75) Inventors: David J. Mitchell, Oviedo, FL (US); John R. Fraley, Fayetteville, AR (US); Jie Yang, Fayetteville, AR (US); Cora Schillig, Orlando, FL (US); Bryon Western, Fayetteville, AR (US); Roberto Marcelo Schupbach, Fayetteville, AR (US)

(73) Assignees: Siemens Energy, Inc., Orlando, FL (US); Arkansas Power Electronics International, Inc., Fayetteville, AR (US)

( * ) Notice: Subject to any disclaimer, the term of this patent is extended or adjusted under 35 U.S.C. 154(b) by 404 days.

(21) Appl. No.: 13/537,208

(22) Filed: Jun. 29, 2012

(65) Prior Publication Data

US 2014/0002050 A1 Jan. 2, 2014

(51) Int. Cl.
*G05F 3/16* (2006.01)

(52) U.S. Cl.
USPC ..... 323/314; 323/315

(58) Field of Classification Search
USPC ..... 323/313, 314, 315
See application file for complete search history.

(56) References Cited

U.S. PATENT DOCUMENTS 3,571,694 A 3/1971 Hunger et al.
6,437,550 B2 * 8/2002 Andoh et al. ..... 323/315
7,132,883 B2 11/2006 Huijsing et al.
7,696,817 B1 4/2010 Boucher et al.
7,728,575 B1 * 6/2010 Ozalevli et al. ..... 323/315
8,023,269 B2 9/2011 Mitchell et al.
8,033,722 B2 10/2011 Kulkarni et al.
8,092,080 B2 1/2012 Mitchell et al.
2009/0121896 A1 5/2009 Mitchell et al.
2010/0039289 A1 2/2010 Mitchell et al.
2010/0039290 A1 2/2010 Mitchell et al.

(Continued)

FOREIGN PATENT DOCUMENTS

WO 2010019404 A2 2/2010

OTHER PUBLICATIONS

Patil, "Silicon Carbide JFet Integrated Circuit Technology for High-Temperature Sensors", Department of Electrical Engineering and Computer Science, Case Western Reserve University, May 2009, pp. 1-158 (pp. I-XX are cover page and table of contents), Cleveland, OH.

(Continued)

*Primary Examiner* — Jeffrey Sterrett

(57) ABSTRACT

A voltage regulator circuitry (50) adapted to operate in a high-temperature environment of a turbine engine is provided. The voltage regulator may include a constant current source (52) including a first semiconductor switch (54) and a first resistor (56) connected between a gate terminal (G) and a source terminal (S) of the first semiconductor switch. A second resistor (58) is connected to the gate terminal of the first semiconductor switch (54) and to an electrical ground (64). The constant current source is coupled to generate a voltage reference across the second resistor 58. A source follower output stage 66 may include a second semiconductor switch (68) and a third resistor (58) connected between the electrical ground and a source terminal of the second semiconductor switch. The generated voltage reference is applied to a gating terminal of the second semiconductor switch (58).

22 Claims, 3 Drawing Sheets

(56) References Cited

U.S. PATENT DOCUMENTS

| | | | | |
|---|---|---|---|---|
| 2010/0078202 | A1 | 4/2010 | Mitchell et al. | |
| 2014/0002050 | A1 * | 1/2014 | Mitchell et al. | 323/311 |

OTHER PUBLICATIONS

Neudeck et al, "Extreme temperature 6H-SiC JFET integrated circuit technology", Phys. Status Solidi A 206, No. 10, pp. 2329-2345 (2009) / DOI 10.1002/pssa.200925188, Cleveland, OH.

Tomana et al., "A Hybrid Silicon Carbide Differential Amplifier for 350° C. Operation", IEEE Transactions on Components, Hybrids, and Manufacturing Technology, vol. 16, No. 5, Aug. 1993, pp. 536-542, Auburn, AL.

Yang et al, "An All Silicon Carbide High Temperature (450+° C.) High Voltage Gain AC Coupled Differential Amplifier", Materials Science Forum vols. 679-680 (2011) pp. 746-749, Mar. 28, 2011 at www.scientific.net © (2011) Trans Tech Publications, Switzerland, doi: 10.4028.

Neudeck, "Silicon Carbide Integrated Circuit Fabricated and Electrically Operated for 2000 hr at 500° C.", http://www.grc.nasa.gov/WWW/RT/2007/Inst-Cnt/17-RIS-neudeck.html, pp. 1-4, Nov. 7, 2008, Ohio Aerospace Institute (OAI) Brook Park, OH.

Seitz, "Designing with Thermocouples", Technology edge, © National Semiconductor Corporation 2009, Application Note AN-1952, pp. 1-3, Santa Clara, CA.

Meijer et al., "Features and limitations of CMOS Voltage References", Delft University of Technology, Faculty Information Technology and Systems, circa 2000, pp. 17-23, The Netherlands.

Thomas et al., "Optimization of SiGe bandgap-based circuits for up to 300° C. operation", Solid-State Electronics 56 (2011) pp. 47-55, © 2010 Elsevier Ltd., Atlanta, GA.

"Voltage References", MT-087 Tutorial, Rev. 0, Oct. 2008, WK, pp. 1-18, copyright 2009 Analog Devices, Inc.

International Search Report of Application No. PCT/US2013/045314 dated Jun. 23, 2014.

* cited by examiner

VOLTAGE REGULATOR CIRCUITRY OPERABLE IN A HIGH TEMPERATURE ENVIRONMENT OF A TURBINE ENGINE

FIELD OF THE INVENTION

The present invention is generally related to electronic circuits, and more particularly, to circuitry, which may be adapted to operate in a high temperature environment of a turbine engine.

BACKGROUND OF THE INVENTION

Turbine engines, such as gas turbine engines, may be used in a variety of applications, such as driving an electric generator in a power generating plant or propelling a ship or an aircraft. Firing temperatures of modern gas turbine engines continue to increase in response to the demand for higher combustion efficiency.

It may be desirable to use circuitry, such as may be used in a wireless telemetry system, to monitor operational parameters of the engine. For example, to monitor operating temperatures of components of the turbine, such as a turbine blade, or to monitor operational stresses placed upon such components during operation of the engine. Aspects of the present invention offer improvements in connection with such a circuitry.

BRIEF DESCRIPTION OF THE DRAWINGS

The invention is explained in the following description in view of the drawings that show.

DETAILED DESCRIPTION OF THE INVENTION

Example embodiments of the present invention may be directed to electronic circuitry, which, in one example application, may be used in an internal combustion engine, such as a turbine engine, instrumented with a telemetry system. This example application may allow transmitting sensor data from a movable component, such as a rotatable turbine engine blade, having certain electronic circuitry, which, for example, may operate in an environment having a temperature exceeding approximately 300° C.

For purposes of the disclosure herein, the term "high temperature" environment without additional qualification may refer to any operating environment, such as that within portions of a turbine engine, having a maximum operating temperature exceeding approximately 300° C. It will be appreciated that aspects of the present invention are not necessarily limited to a high temperature environment, since circuitry embodying aspects of the present invention may be used equally effective in a non-high temperature environment.

Figure 1:
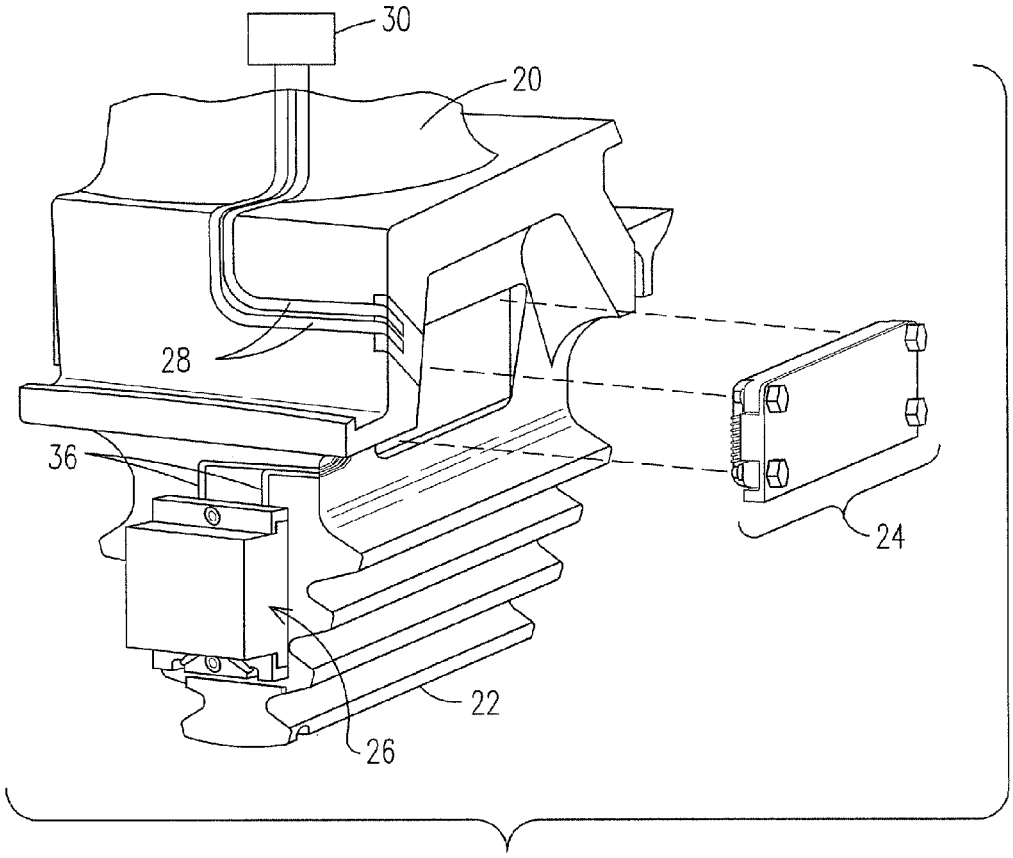
FIG. 1 is a partial isometric view of an exemplary turbine blade including electronic circuitry, which may be used by a wireless telemetry system to monitor operational parameters of the blade.

FIG. 1 illustrates a turbine blade 20 (fragmentarily illustrated), as may be instrumented with an example telemetry system, which may include a wireless telemetry transmitter assembly 24 and an antenna assembly 26. Lead lines or connectors 28 may extend from one or more sensors, such as sensor 30, to telemetry transmitter assembly 24, which may be mounted proximate a blade root 22 and may include various telemetry transmitter circuitry. Example sensors may be embedded and/or may be surface-mounted sensors, such as strain gages, thermocouples, heat-flux sensors, pressure transducers, micro-accelerometers or any other desired sensor. Lead lines 28 may route electronic data signals from sensor 30 to telemetry transmitter assembly 24, where the signals may be processed by a processor. Further lead lines or electrical connectors 36 may be used for routing electronic data signals from telemetry transmitter circuitry to antenna assembly 26.

Figure 2:
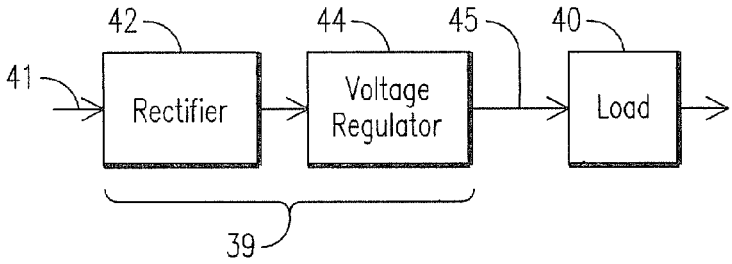
FIG. 2 is a block diagram of an example power source circuitry, which may be used by the telemetry system, and which may benefit from a voltage regulator embodying aspects of the present invention.

FIG. 2 illustrates a block diagram of an example power source circuitry 39, which may be used in a turbine component (e.g., turbine blade 20 (FIG. 1)) instrumented with a telemetry system. In one example embodiment, one or more loads 40 may be electrically powered by power source circuitry 39. By way of example, load 40 may be electronic circuitry, such as sensing, signal conditioning, and/or telemetry circuitry, which may be part of the telemetry system.

Power source circuitry 39 may acquire electrical power by way of one or more power-harvesting modalities, such as induced RF (radio frequency) energy and/or by harvesting thermal or vibrational power within the turbine engine. For example, thermopiles may be used to generate electricity from thermal energy, or piezoelectric materials may generate electricity from vibration of the turbine engine. For readers desirous of general background information regarding examples forms of power harvesting modalities, reference is made to U.S. Pat. No. 7,368,827, titled "Electrical Assembly For Monitoring Conditions In A Combustion Turbine Operating Environment", the entire disclosure of which is incorporated herein by reference.

Regardless of the specific power-harvesting modality, in one example embodiment AC (alternating current) power 41 may be supplied to a rectifier 42, which converts the AC input to a DC (direct current) output, which is coupled to a voltage regulator 44, which may be configured to maintain a relatively constant DC voltage output 45, even in the presence of variation of the harvested AC input voltage. It will be appreciated that a constant voltage output may be desired to achieve a required measurement accuracy and/or stability for any given engine parameter being measured.

Figure 3:
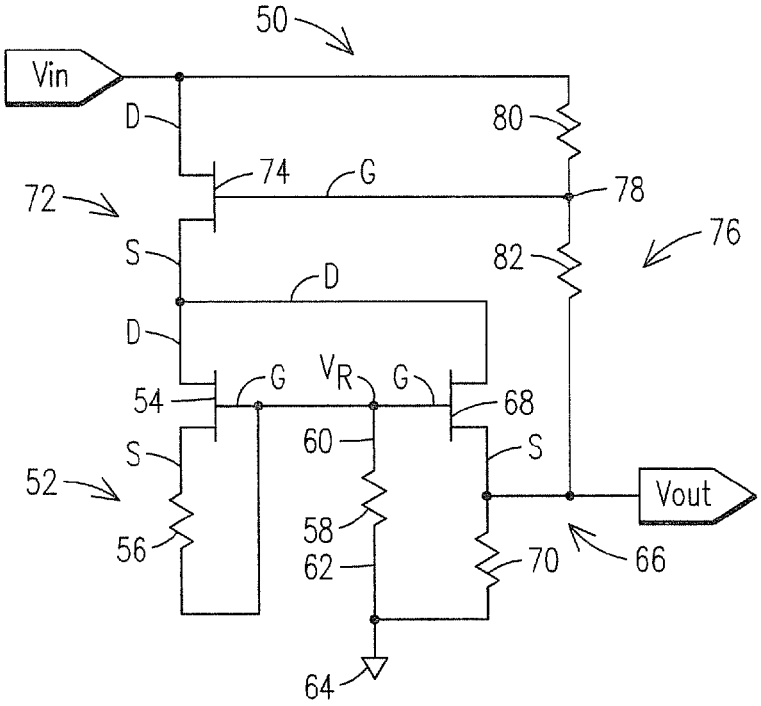
FIG. 3 is a schematic representation of one example embodiment of a voltage regulator embodying aspects of the present invention.
Figure 4:
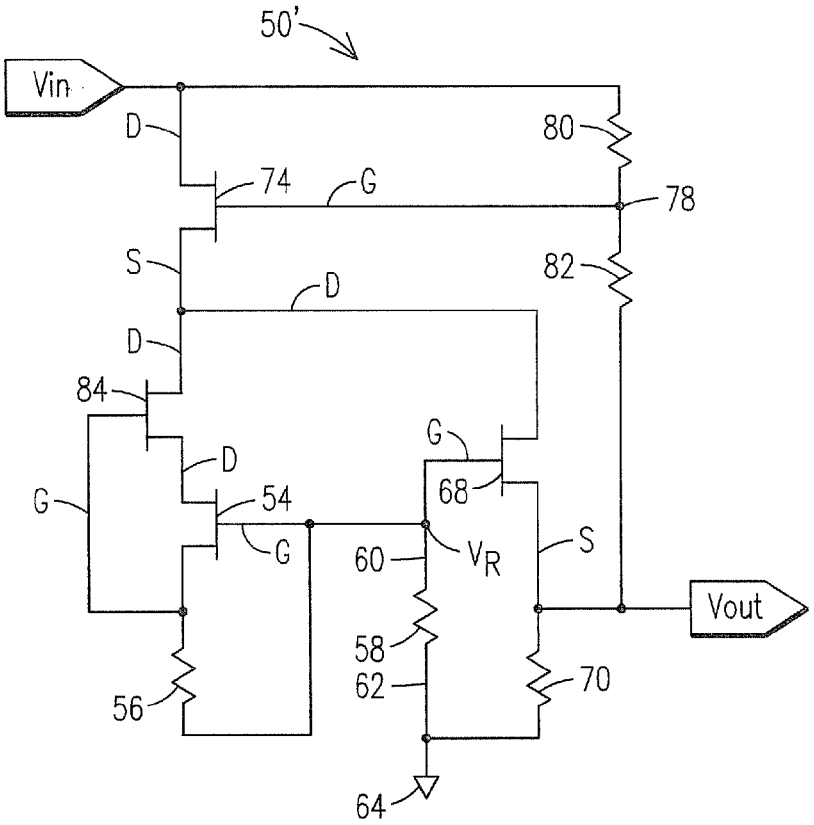
FIG. 4 is a schematic representation of another example embodiment of a voltage regulator embodying aspects of the present invention.

FIGS. 3-4 and related description below will provide details of a voltage regulator 50 embodying aspects of the present invention, which in one example application, may be used in a power source circuitry, as exemplarily illustrated in FIG. 2. It will be appreciated that such example application should not be construed in a limiting sense being that circuitry embodying aspects of the present invention may be used in other applications.

In one example embodiment, voltage regulator 50 may be adapted to operate in a high-temperature environment of a turbine engine. Voltage regulator 50 may include a constant current source 52, such as may include a first semiconductor switch 54 and a first resistor 56 connected between a gate terminal (G) and a source terminal (S) of first semiconductor switch 54.

In one example embodiment, a second resistor 58 may have a first lead 60 connected to the gate terminal (G) of first semiconductor switch 54 and a second lead 62 connected to an electrical ground 64. Constant current source 52 may be coupled to generate a voltage reference (Vr) across second resistor 58. A source follower output stage 66 may include a second semiconductor switch 68 and a third resistor 70 connected between electrical ground 64 and a source terminal (S) of second semiconductor switch 68. As can be appreciate in FIG. 3, first lead 60 of second resistor 58 is connected to apply the generated voltage reference (Vr) to a gating terminal (G) of second semiconductor switch 68. It can be further appreciated that the source terminal (S) of second semiconductor switch 68 supplies a regulated output voltage (Vout) of voltage regulator 50.

In one example embodiment, current source 52 may further include an input stage 72, which may include a third semiconductor switch 74 having a drain terminal (D) connected to receive an input voltage (Vin) (e.g., output from rectifier 42 in FIG. 2) to be regulated by voltage regulator 50. A voltage divider network 76 may provide a voltage divider node 78 connected to a gate terminal (G) of third semiconductor switch 74. Voltage divider network 76 may include a first resistor 80 connected between voltage divider node 78 and the drain (D) of third semiconductor switch 74, and may further include a second resistor 82 connected between voltage divider node 78 and the source (S) of second semiconductor switch 68.

In an alternate embodiment illustrated in FIG. 4, in a voltage regulator 50', input stage 72 of current source 52 may further include a fourth semiconductor switch 84 connected in series circuit between first semiconductor switch 54 and third semiconductor switch 74. In this alternate embodiment, fourth semiconductor switch 84 may have a drain terminal (D) connected to the source terminal (S) of third semiconductor switch 74, a source terminal (S) connected to the drain terminal (D) of first semiconductor switch 54, and a gate terminal (G) connected to the source terminal (S) of first semiconductor switch 54. It will be appreciated that the cascaded arrangement of semiconductor switches 74 and 84 is conducive to a relatively more stable current regulation by current source 52, which in turn is conducive to a relative more stable voltage reference Vr, which constitutes a DC bias for third semiconductor switch 68 and consequently a relatively more stable regulated output voltage, Vout.

In one example embodiment, semiconductor switches 54, 68, 74 and 84 may be n-channel junction gate field-effect transistor (JFET) switches and may comprise a respective high-temperature, wide bandgap material, such as SiC, AlN, GaN, AlGaN, GaAs, GaP, InP, AlGaAs, AlGaP, AlInGaP, and GaAsAlN.

As will be appreciated by one skilled in the art, high-temperature voltage regulation, as would involve zener diodes made of a high-temperature, wide bandgap material is presently not feasible, since zener diodes involving high-temperature materials are not believed to be commercially available. Moreover, p-channel SiC JFETs are presently believed to be impractical in high-temperature applications due to their relatively low-channel mobility. Accordingly, circuitry embodying aspects of the present invention, advantageously overcomes the present unavailability of zener diodes made of high-temperature, wide bandgap materials with n-channel JFETs, and thus such a circuitry may operate within the theoretical temperature limits of high-temperature, wide bandgap material JFETs (e.g., above 500° C.) and effectively provide a substantially stable voltage regulator. In one example application, a voltage regulator in accordance with aspects of the present invention may be utilized to appropriately regulate a power source in a high-temperature environment for powering load circuitry involving relatively low-voltage information signals. For example, prior to the present invention, such load circuitry would have been susceptible to measurement uncertainties resulting from power source instabilities in view of the relatively low-magnitude (e.g., a few millivolts) of the information signals, which may be generated by sensors, such as thermocouples and strain gauges.

In one example embodiment, the magnitude of the regulated output voltage Vout may be adjustable by adjusting a ratio of the respective resistance values of first and second resistors 56 and 58. Typically, the output voltage of known voltage regulators is not adjustable, and, if so desired, for known voltage regulators an operational amplifier would be involved. However, for high-temperature applications, operational amplifiers made of high-temperature, wide bandgap materials are not believed to be commercially available. Accordingly, a voltage regulator embodying aspects of the present invention in a simplified manner (e.g., with lesser active components) may be conveniently configured to adjust the magnitude of the regulated output voltage Vout, as may involve operation in a high-temperature environment. If optionally desired, a resistive temperature detector (RTD) or similar may be combined with the first and second resistors 56 and 58 to control the regulated output voltage Vout in accordance with temperature changes. It is contemplated that because of the improved stability and repeatability, which can be achieved with a voltage regulator embodying aspects of the present invention, any voltage regulation variation, which may be experienced by the voltage regulator under temperature changes would be consistently repeatable, which means any such voltage regulation variation resulting from temperature changes can be appropriately compensated using techniques well-understood by those skilled in the art.

Figure 5:
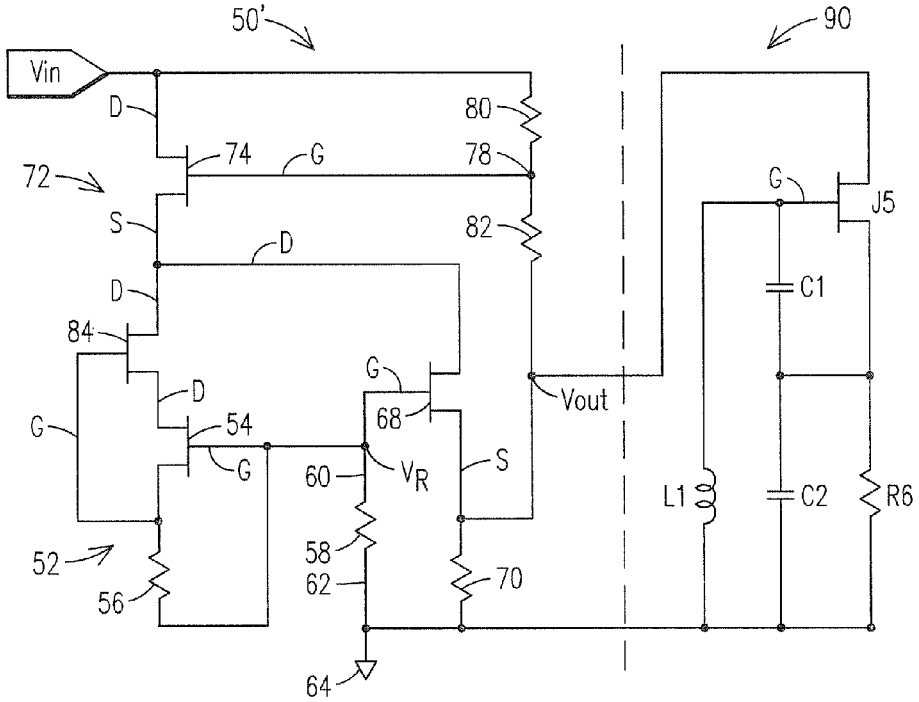
FIG. 5 is a schematic representation of a voltage regulator embodying aspects of the present invention, as may be integrated in a wireless telemetry system.

FIG. 5 is a schematic representation of a voltage regulator 50' embodying aspects of the present invention, as may be integrated in a wireless telemetry system. In one example application, voltage regulator 50' may be arranged to power an example RF transmitter 90, as may be configured to generate a frequency modulated (FM) signal, which may be encoded (e.g., modulated) with information on an RF carrier wave. For example, in this example application transistor J5 receives regulated power Vout from voltage regulator 50', and this is conducive to a relatively more accurate and stable encoding of information, regardless of variation in the AC harvested power.

While various embodiments of the present invention have been shown and described herein, it will be apparent that such embodiments are provided by way of example only. Numerous variations, changes and substitutions may be made without departing from the invention herein. Accordingly, it is intended that the invention be limited only by the spirit and scope of the appended claims.

The invention claimed is:

1. A voltage regulator circuitry adapted to operate in a high-temperature environment of a turbine engine, the voltage regulator circuitry comprising:

a constant current source comprising at least a first semiconductor switch and a first resistor connected between a gate terminal and a source terminal of the first semiconductor switch;

a second resistor having a first lead connected to the gate terminal of the first semiconductor switch and a second lead connected to an electrical ground, wherein the constant current source is coupled to generate a voltage reference across the second resistor; and a source follower output stage comprising a second semiconductor switch and a third resistor connected between the electrical ground and a source terminal of the second semiconductor switch, wherein the first lead of the second resistor is connected to apply the generated voltage reference to a gating terminal of the second semiconductor switch.

2. A telemetry system comprising the voltage regulator circuitry of claim 1.

3. The voltage regulator circuitry of claim 1, wherein the current source further comprises an input stage comprising a third semiconductor switch having a drain terminal connected to receive an input voltage to be regulated by the voltage regulator.

4. The voltage regulator circuitry of claim 3, further comprising a voltage divider network having a voltage divider node connected to a gate terminal of the third semiconductor switch.

5. The voltage regulator circuitry of claim 4, wherein the voltage divider network comprises a first resistor connected between the voltage divider node and the drain of the third semiconductor switch, and a second resistor connected between the voltage divider node and the source of the second semiconductor switch.

6. The voltage regulator circuitry of claim 3, wherein the input stage of the current source further comprises a fourth semiconductor switch connected in series circuit between the first and third semiconductor switches.

7. The voltage regulator circuitry of claim 6, wherein the fourth semiconductor switch has a drain terminal connected to a source terminal of the third semiconductor switch, a source terminal connected to a drain terminal of the first semiconductor switch, and a gate terminal connected to the source terminal of the first semiconductor switch.

8. The voltage regulator circuitry of claim 6, wherein the respective semiconductor switches comprise n-channel junction field-effect transistor (JFET) switches.

9. The voltage regulator circuitry of claim 6, wherein the respective semiconductor switches comprise comprise a respective high-temperature, wide bandgap material.

10. The voltage regulator circuitry of claim 9, wherein the high-temperature, wide bandgap material is selected from the group consisting of SiC, AlN, GaN, AlGaN, GaAs, GaP, InP, AlGaAs, AlGaP, AlInGaP, and GaAsAlN.

11. The voltage regulator circuitry of claim 1, wherein the source terminal of the second semiconductor switch supplies a regulated output voltage of the voltage regulator.

12. The voltage regulator circuitry of claim 11, wherein a ratio of respective resistance values of the first and second resistors is selected to adjust a magnitude of the regulated output voltage of the voltage regulator.

13. A voltage regulator circuitry comprising:

a constant current source comprising at least a first semiconductor switch and a first resistor connected between a gate terminal and a source terminal of the first semiconductor switch, the constant current source further comprising a cascaded input stage connected to receive an input voltage to be regulated by the voltage regulator;

a second resistor having a first lead connected to the gate terminal of the first semiconductor switch and a second lead connected to an electrical ground, wherein the constant current source is coupled to provide a voltage reference across the second resistor; and a source follower output stage comprising a second semiconductor switch and a third resistor connected between the electrical ground and a source terminal of the second semiconductor switch, wherein the first lead of the second resistor is connected to apply the generated voltage reference to a gating terminal of the second semiconductor switch.

14. The voltage regulator circuitry of claim 13, wherein the source terminal of the second semiconductor switch supplies a regulated output voltage of the voltage regulator.

15. The voltage regulator circuitry of claim 13, wherein the cascaded input stage comprises a third semiconductor switch having a drain terminal connected to receive the input voltage to be regulated by the voltage regulator and a fourth semiconductor switch connected in series circuit between the first and third semiconductor switches.

16. The voltage regulator circuitry of claim 15, further comprising a voltage divider network having a voltage divider node connected to a gate terminal of the third semiconductor switch.

17. The voltage regulator circuitry of claim 16, wherein the voltage divider network comprises a first resistor connected between the voltage divider node and the drain of the third semiconductor switch, and a second resistor connected between the voltage divider node and the source of the second semiconductor switch.

18. The voltage regulator circuitry of claim 15, wherein the semiconductor switches comprise n-channel junction field-effect transistor (JFET) switches.

19. The voltage regulator circuitry of claim 15, wherein the respective first, second and third semiconductor switches comprise a respective high-temperature, wide bandgap material.

20. The voltage regulator circuitry of claim 19, wherein the high-temperature, wide bandgap material is selected from the group consisting of SiC, AlN, GaN, AlGaN, GaAs, GaP, InP, AlGaAs, AlGaP, AlInGaP, and GaAsAlN.

21. The voltage regulator circuitry of claim 15, wherein the fourth semiconductor switch has a drain terminal connected to a source terminal of the third semiconductor switch, a source terminal connected to a drain terminal of the first semiconductor switch, and a gate terminal connected to the source terminal of the first semiconductor switch.

22. The voltage regulator circuitry of claim 13, adapted to operate in a high temperature environment of a turbine engine, and operatively coupled to a telemetry system affixed to a rotatable component of the turbine engine.

* * * * *